US007026906B2

(12) United States Patent
Huang

(10) Patent No.: US 7,026,906 B2
(45) Date of Patent: Apr. 11, 2006

(54) CIRCUIT BREAKER

(76) Inventor: Albert Huang, 3F, No. 146, Sec. 4, Chungking N. Rd., Taipei (TW)

( * ) Notice: Subject to any disclaimer, the term of this patent is extended or adjusted under 35 U.S.C. 154(b) by 264 days.

(21) Appl. No.: 10/739,104

(22) Filed: Dec. 19, 2003

(65) Prior Publication Data

US 2005/0134421 A1 Jun. 23, 2005

(51) Int. Cl.
*H01H 37/52* (2006.01)

(52) U.S. Cl. ..... 337/59; 337/66; 337/91

(58) Field of Classification Search ..... 337/59, 337/66, 200; 200/339, 341, 345
See application file for complete search history.

(56) References Cited

U.S. PATENT DOCUMENTS

| | | | | | |
|---|---|---|---|---|---|
| 2,681,962 | A * | 6/1954 | Sundt | 337/69 |
| 3,036,178 | A * | 5/1962 | Brackett | 337/13 |
| 3,702,454 | A * | 11/1972 | Brown | 337/77 |
| 4,363,016 | A * | 12/1982 | Unger | 337/56 |
| 4,528,538 | A * | 7/1985 | Andersen | 337/43 |
| 5,498,846 | A * | 3/1996 | Chin | 200/557 |
| 5,541,569 | A * | 7/1996 | Jang | 337/68 |
| 5,742,219 | A * | 4/1998 | Moalem et al. | 337/68 |
| 6,154,116 | A * | 11/2000 | Sorenson | 337/37 |
| 6,275,134 | B1 * | 8/2001 | Chen | 337/37 |
| 6,307,460 | B1 * | 10/2001 | Yu | 337/37 |
| 6,323,450 | B1 * | 11/2001 | Chen | 200/553 |
| 6,480,090 | B1 * | 11/2002 | Wang | 337/59 |
| 6,621,402 | B1 * | 9/2003 | Huang | 337/66 |
| 2005/0040925 | A1 * | 2/2005 | Huang | 337/66 |

FOREIGN PATENT DOCUMENTS

CH 647094 A * 12/1984

* cited by examiner

*Primary Examiner*—Anatoly Vortman
(74) *Attorney, Agent, or Firm*—Bacon & Thomas, PLLC

(57) ABSTRACT

A circuit breaker has a housing in which two conductive plates, a bimetallic strip and a swing plate with a U-shaped notch are retained, wherein a switch is mounted at the top of the housing. Each conductive plate has an end protruding from a bottom of the body. The bimetallic strip with a movable node connects to one of the conductive plates, where the movable node contacts an immovable node secured at the other conductive plate. The swing plate is attached to near the bimetallic strip near the movable node. A pivot block linked to the bottom of the switch is placed in the U-shaped notch. When current exceeds a predetermined level, the bimetallic strip deforms so that the movable node is separated from the immovable node. Since the pivot block has a lobe configuration, the pivot block can be moved in the notch smoothly and easily separated from the immovable node.

4 Claims, 6 Drawing Sheets

CIRCUIT BREAKER

BACKGROUND OF THE INVENTION

1. Field of the Invention

The present invention relates to a circuit breaker, and more particularly to a circuit breaker to automatically interrupt the electricity supply when the current flow exceeds a predetermined level.

2. Description of Related Art

To protect electrical equipment, a circuit breaker is generally used to automatically discontinue the electricity supply when the device abnormally starts to draw an excessive amount of electricity, which is so called over current.

With reference to FIG. 5, a conventional circuit breaker includes a housing (70) arranged with two conductive plates (71) (72), wherein a bimetallic strip (73) is connected to one conductive plate (72). The bimetallic strip (73) has a tongue portion (74) to which a movable node (76) is mounted. An immovable node (75) is secured at one end of the other plate (71) to correspondingly contact the movable node (76).

A movable arm (77) and a plate (79) are placed inside the housing (70). The movable arm (77) has two ends from which a lateral portion (770) and an upward partition plate (78) are respectively extended. A spring (82) retained in the housing (70) abuts against a lower edge of the lateral portion (770) of the movable arm (77). The plate (79) has a foot portion (80) protruding from the bottom edge of the plate (79). A switch (81) is pivoted to a stub (not numbered) protruded from the housing (70). The bottom portion of the switch (81) touches the lateral portion (770) of the movable arm (77) and a top point of the plate (79) as shown in FIGS. 6 to 8.

With reference to FIG. 6, when a current flowing through the two conductive plates (71)(72) increases abnormally, the bimetallic strip (73) becomes hot and deforms. The spring (82) will push the lateral portion (770) upward so that the switch (81) is switched toward one side (the left side on the drawing). Because the movable arm (77) is pushed upward by the spring (82), the partition plate (78) accordingly moves upward at a position between the movable node (76) and the immovable node (75) thus separating them from each other.

With reference to FIG. 7, by pressing the switch (81), the lateral portion (770) of the movable arm (77) is pressed downward and thus the partition plate (78) moves downward also, whereby the movable node (76) and the immovable node (75) will contact each other.

To terminate the electricity supply by human force, the plate (79) is moved downward by pressing the switch (81) thus allowing the foot portion (80) to move the tongue portion (74) away to separate the movable node (76) from the immovable node (75). Meanwhile, because the switch (81) has been switched toward the left side, the compressed spring (80) turns to the released status and pushes the lateral portion (770) upward. Therefore, the partition plate (78) is located between the movable node (76) and the immovable node (75).

With reference to FIG. 8, if the pressing force applied on the switch (81) is not strong enough, the movable arm (77) is just at the middle position and the spring (82) is unable to push the movable arm (77) upward. The movable node (76) and the immovable node (75) become very close but do not contact each other, so that a possible electric arc with extremely high temperature may take place and damage the two nodes (75)(76).

SUMMARY OF THE INVENTION

The main objective of the present invention is to provide a novel circuit breaker that operates smoothly to prevent any possible electric arc during the switching.

To accomplished the objective, the circuit breaker comprises:

a housing composed of two correspondingly assembled cases, wherein a first conductive plate and a second conductive plate are retained inside the housing, and a first end of each conductive plate is protruding from a bottom of the housing;

a bimetallic strip placed in the housing and secured to the first conductive plate, wherein a movable node is provided at a second end of the bimetallic strip to electrically contact with the second conductive plate;

a swing plate having a notch, wherein the swing plate is pivotally attached inside the housing and connected at the second end of the bimetallic strip near the movable node; and a switch having bottom from which a pivot block extends in the notch of the swing plate, wherein the switch is pivotally mounted on a top of the housing to place the switch in an open circuit mode in which said movable node and immovable node are separated from each other and a closed circuit mode in which said movable node and immovable node contact each other;

wherein when current flow through the bimetallic strip exceeds a predetermined level, said bimetallic strip deforms to disconnect said movable node and immovable node and place the switch is in the open circuit mode.

Other objects, advantages and novel features of the invention will become more apparent from the following detailed description when taken in conjunction with the accompanying drawings.

DETAILED DESCRIPTION OF THE PREFERRED EMBODIMENT

Figure 1:
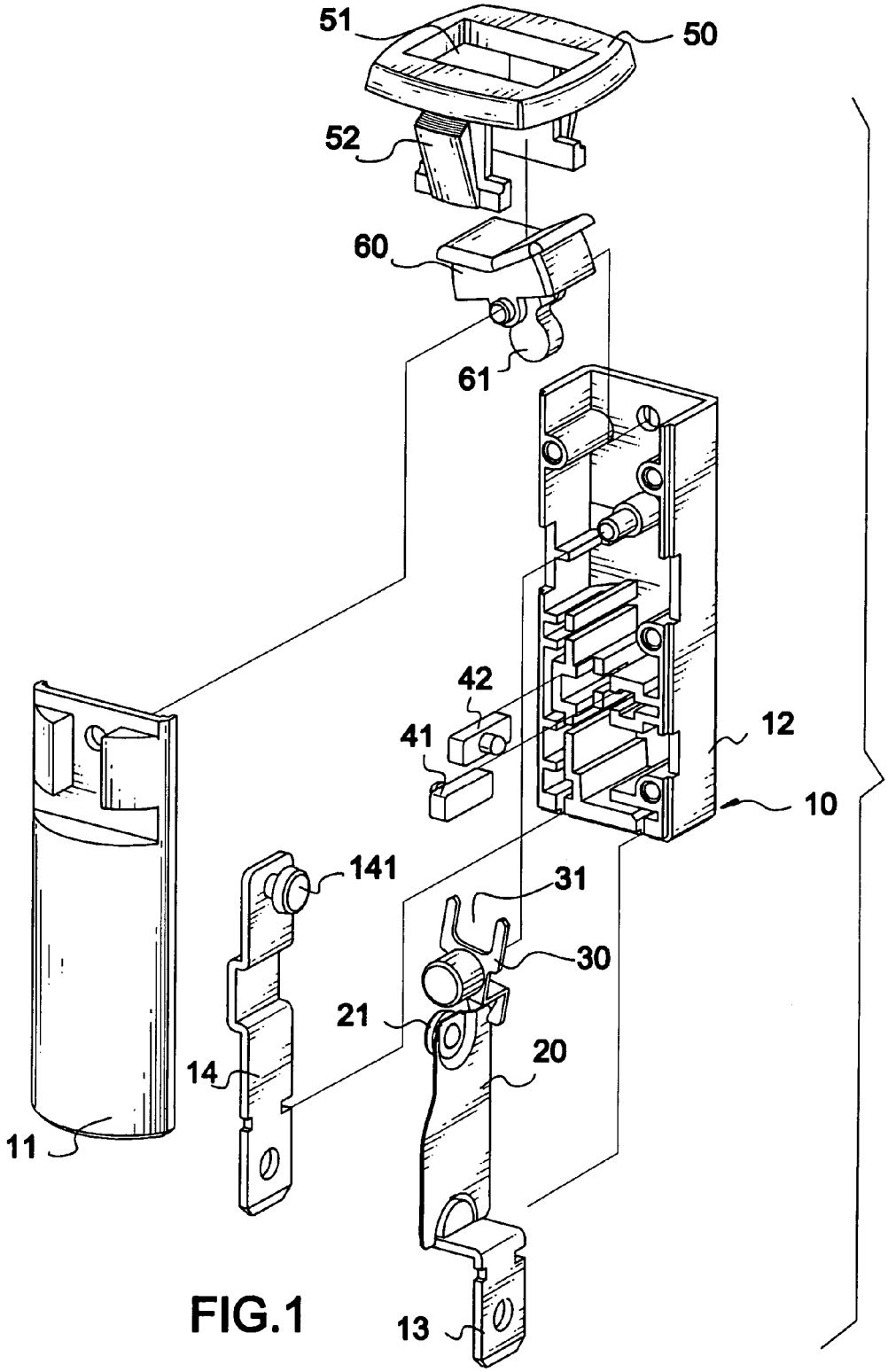
FIG. 1 is an exploded perspective view of a circuit breaker in accordance with the present invention.
Figure 2:
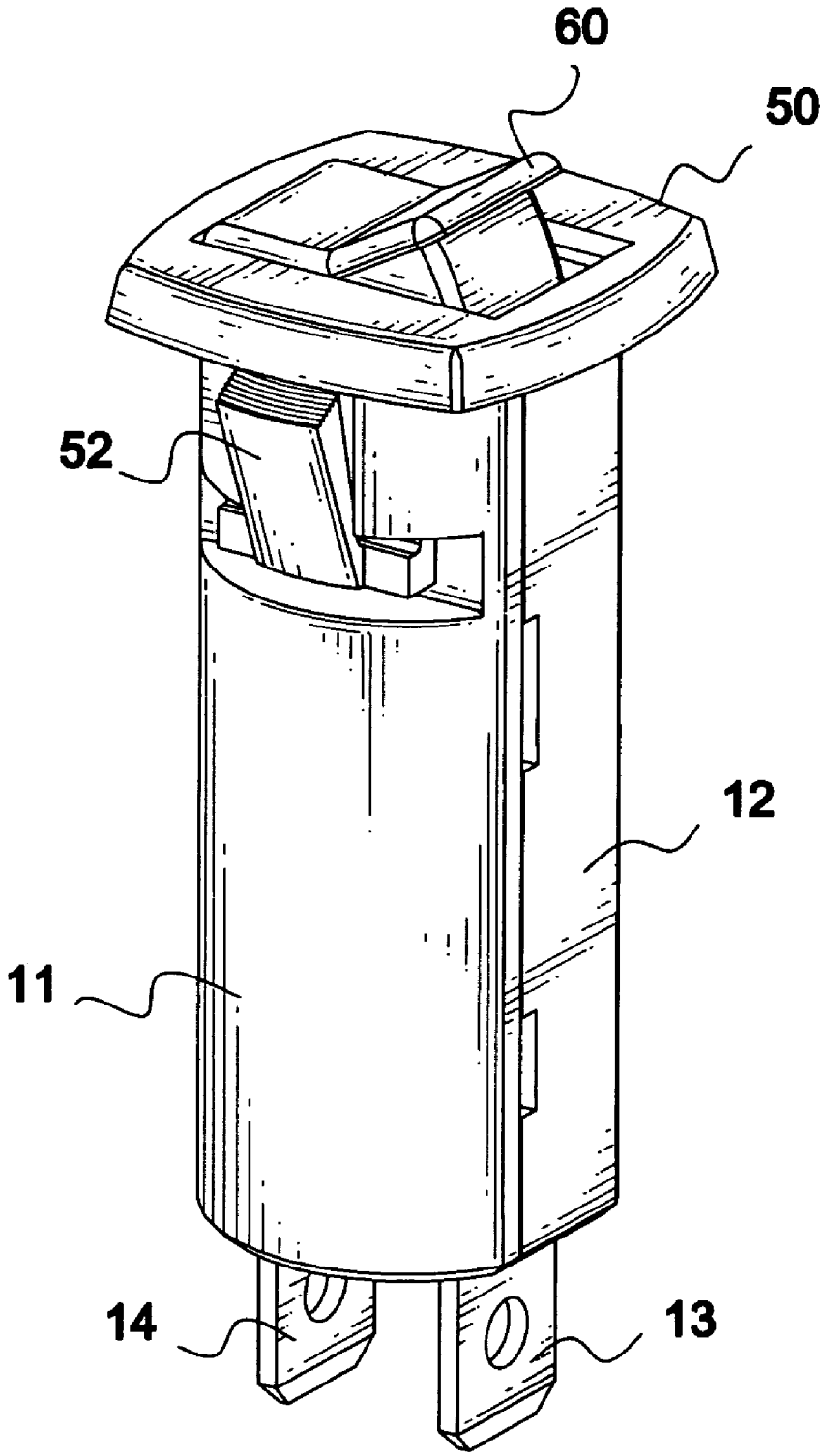
FIG. 2 perspective view of the circuit breaker of FIG. 1 in an assembled status.

With reference to FIGS. 1 and 2, a circuit breaker in accordance with the present invention includes a housing (10), two conductive plates (13) (14) in the housing (10), a bimetallic strip (20) connected to the conductive plate (13), a mounting frame (50) and a switch (60).

The housing (10) is formed by two cases assembled correspondingly, referred to as a front case (11) and a rear case (12) hereinafter. The first conductive plate (13) and the second conductive plate (14) are securely retained inside the housing (10), where one distal end of each plate (12)(13) protrudes from the housing (10) as a respective one of two terminals. An immovable node (141) is secured at one end of the second conductive plate (14) in the housing (10).

The bimetallic strip (20) has a first end that connects to the first conductive plate (13). A second end of the bimetallic strip (20) is connected with a movable node (21). A swing plate (30) is also attached to the second end of the bimetallic strip (20) near the movable node (21). It is to be noted that the swing plate (30) is pivotally attached in the rear case (12) and forms a U-shaped notch (31).

Figure 3:
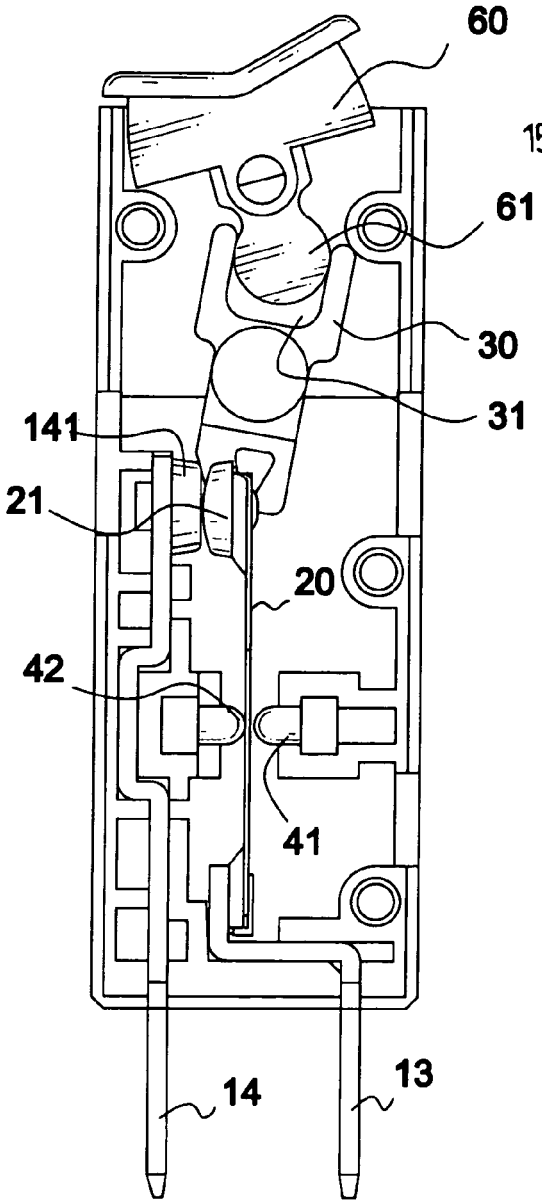
FIG. 3 is a first operational view of the circuit breaker of FIG. 1 illustrating two nodes contacting each other.
Figure 4:
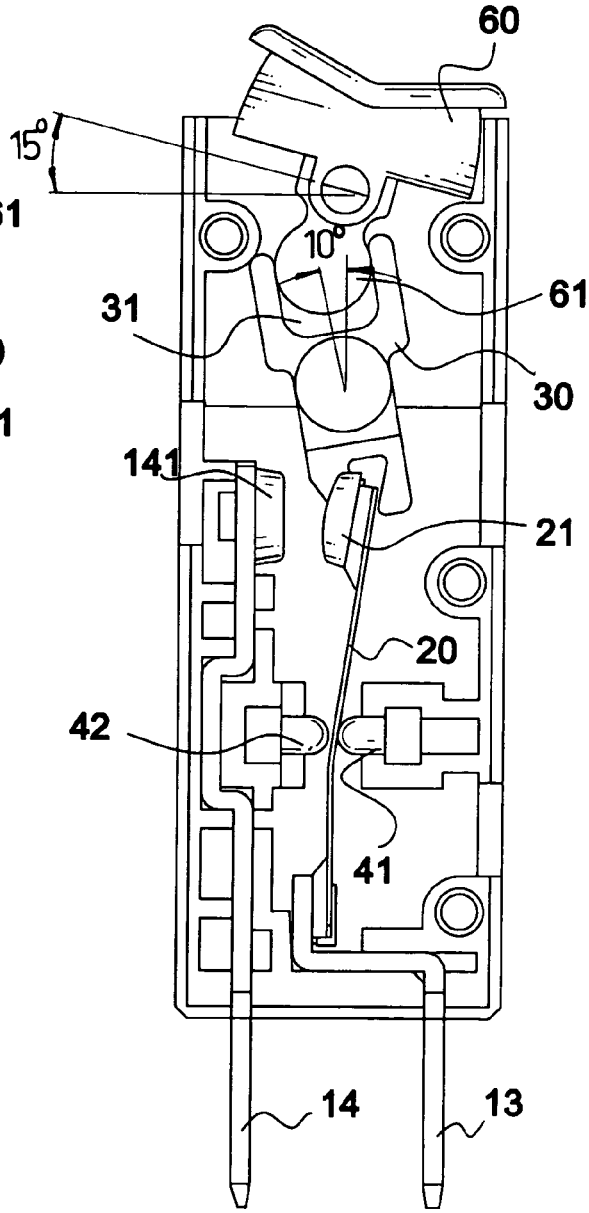
FIG. 4 is a second operational view of the circuit breaker of FIG. 1 illustrating two nodes separated from each other.
Figure 5:
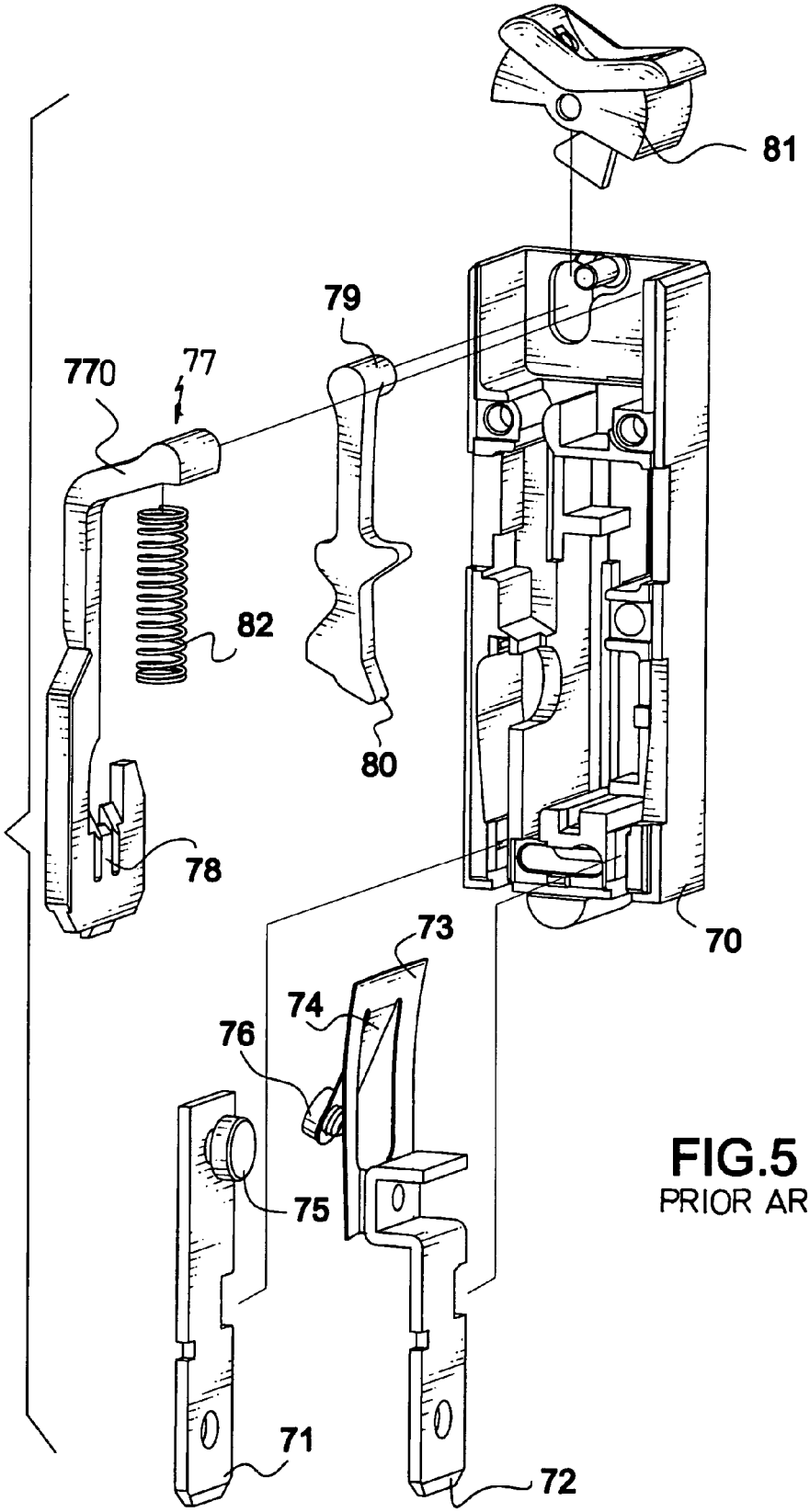
FIG.5 PRIOR ART
FIG. 5 is an exploded perspective view of a conventional circuit breaker.
Figure 6:
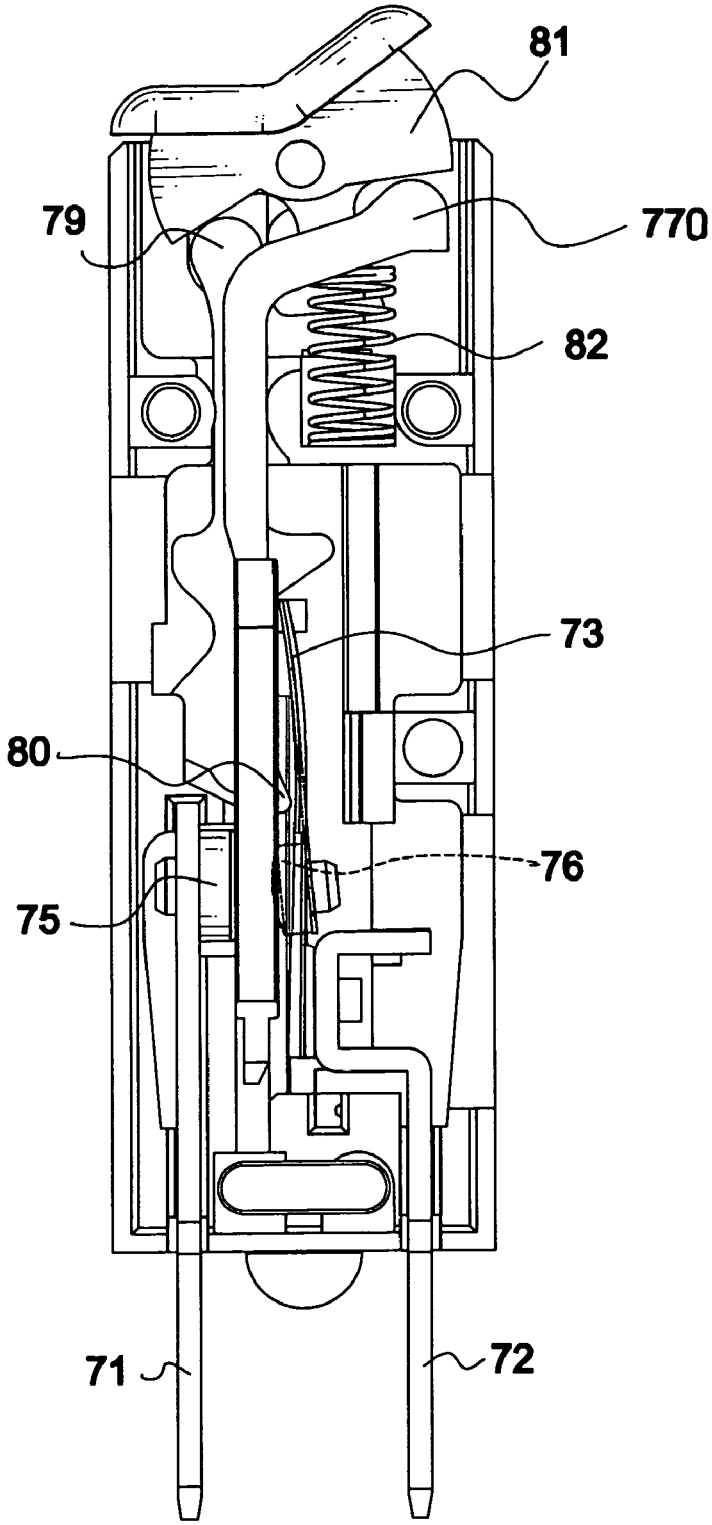
FIG.6 PRIOR ART
FIG. 6 is a first operational view of the conventional circuit breaker of FIG. 5.
Figure 7:
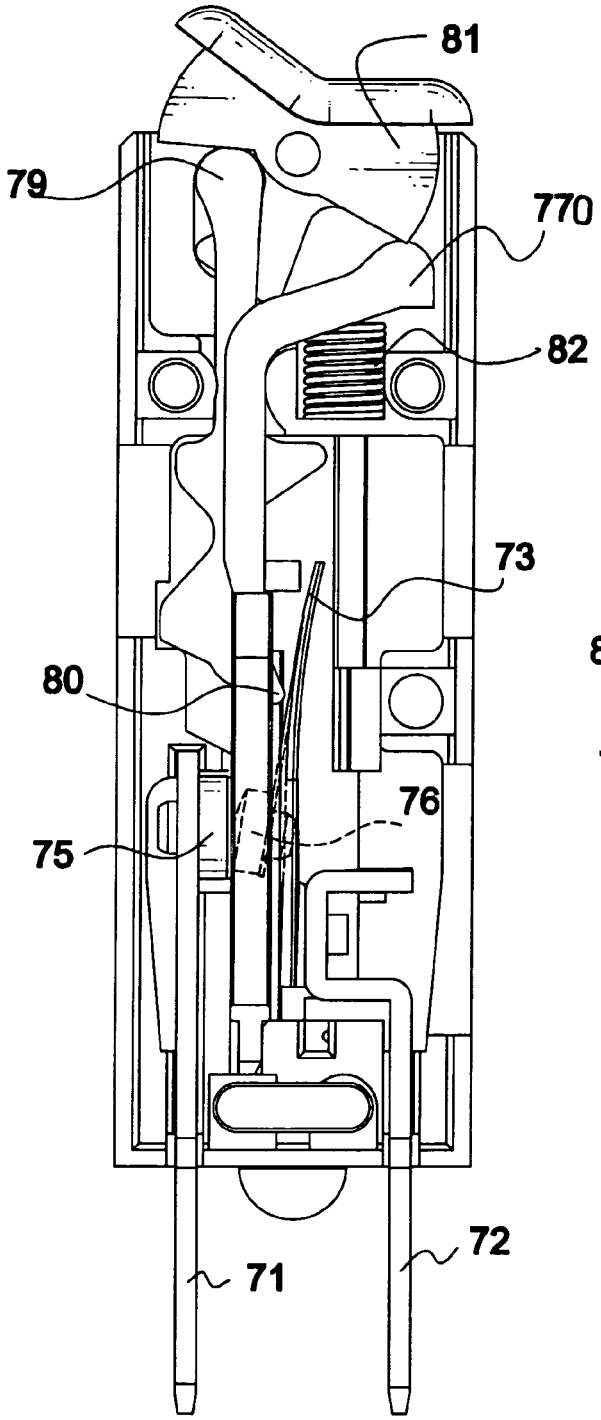
FIG.7 PRIOR ART
FIG. 7 is a second operational view of the conventional circuit breaker of FIG. 5.
Figure 8:
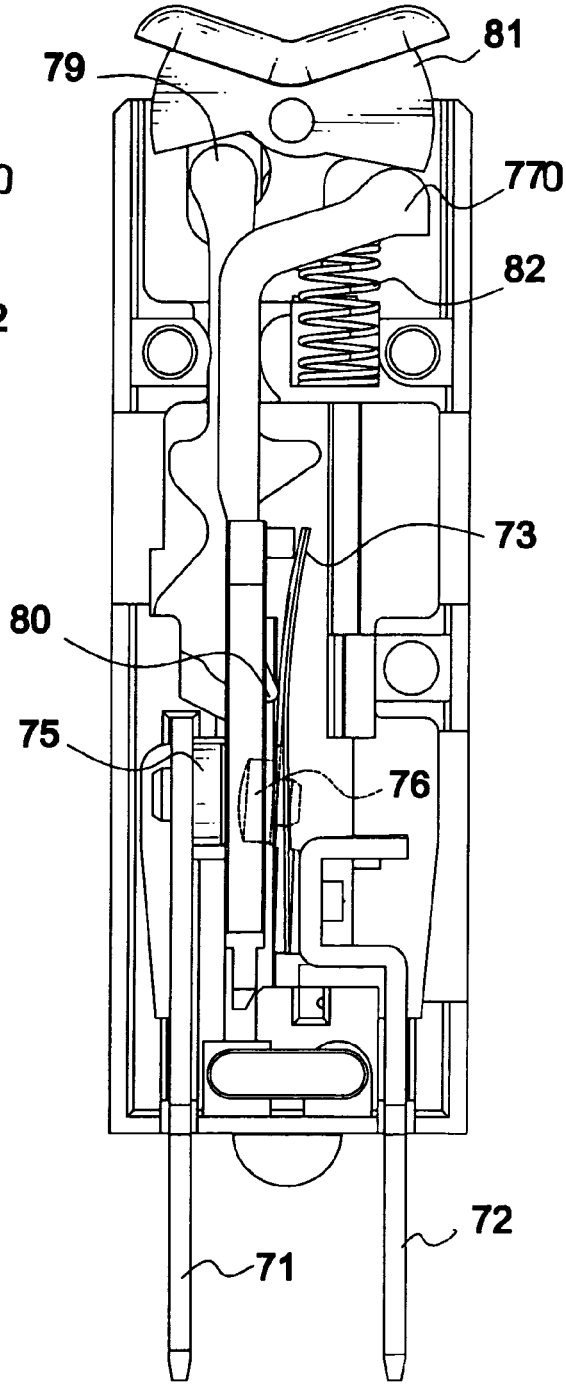
FIG.8 PRIOR ART
FIG. 8 is a third operational view of the conventional circuit breaker of FIG. 5.

A first protruding block (41) and a second protruding block (42) are also retained in the rear case (12) in opposite positions, whereby the metallic strip (20) is located between the first protruding block (41) and the second protruding block (42)(as shown in FIGS. 3 and 4).

The mounting frame (50) having an opening (51) defined at its central position is attached at the top of the housing (10). Two opposite hooks (52) integrally extend downward from the switch mounting frame (50) to engage at the outer surface of the front case (11) and the rear case (12) respectively.

The switch (60), within the opening (51) of the mounting frame (50), is pivoted between the front case (11) and the rear case (12). A pivot block (61) formed with a smooth lobe configuration is attached to the bottom of the switch (60). In assembly, the lobe of the pivot block (61) is positioned in the U-shaped notch (31) of the swing plate (30). With reference to FIG. 3, when the switch (60) is pressed to one side for forming a current path, the lobe of the pivot block (61) pushes the swing plate (30) to deflect to a first direction in such a way that allows the movable node (21) and the immovable node (141) to be able to contact to each other. Therefore a current is allowed to flow through the two conductive plates (13)(14).

When the current flowing through the bimetallic strip (20) increases abnormally, the bimetallic strip (20) will automatically deform because of heat caused by the rising current. At the same time, the movable node (21) separates from the immovable node (141) to interrupt the current path. The first protruding block (41) functions as a fulcrum to limit a bending angle while the bimetallic strip (20) is bent away from the immovable node (141). The deformed bimetallic strip (20) simultaneously pushes the swing plate (30) to deflect to a second direction. With the smooth periphery, the pivot block (61) is easily moved in the U-shaped notch (31) whereby the switch (60) is moved to another side.

The feature of the present invention is that the swing plate (30) and the pivot block (61) are provided between the switch (60) and the bimetallic strip (20). With such a configuration, even when the switch (60) is pressed by minor force, the bimetallic strip (20) still can be easily bent away from the immovable node (141).

Moreover, another feature of the present invention is that the ON or OFF status of the switch (60) can be easily recognized. As shown in FIG. 4, if the bending angle of the swing plate (20) is 10 degrees when the bimetallic strip (20) is separated from the immovable node (141), the rotating angle of the switch (60) is approximately 15 degrees.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A circuit breaker comprising:

a housing composed of two correspondingly assembled cases, wherein a first conductive plate and a second conductive plate are retained inside the housing, and a first end of each conductive plate is protruding from a bottom of the housing;

a bimetallic strip placed in the housing and secured to the first conductive plate, wherein a movable node is provided at a second end of the bimetallic strip to electrically contact with the second conductive plate;

a swing plate having a notch, wherein the swing plate is pivotally attached inside the housing and connected at the second end of the bimetallic strip near the movable node; and a switch having bottom from which a pivot block extends in the notch of the swing plate, wherein the switch is pivotally mounted on a top of the housing to place the circuit breaker in an open circuit mode in which said movable node and immovable node are separated from each other and a closed circuit mode in which said movable node and immovable node contact each other;

wherein when current flow through the bimetallic strip exceeds a predetermined level, said bimetallic strip deforms to disconnect said movable node and immovable node thus placing the switch in the open circuit mode.

2. The circuit breaker as claimed in claim 1, wherein the notch of the swing plate is a U-shaped notch.

3. The circuit breaker as claimed in claim 2, wherein the pivot block has a lobe configuration.

4. The circular breaker as claimed in claim 3, wherein two protruding blocks are retained in the housing in opposite positions, where said metallic strip is located between the two protruding blocks.

* * * * *